US006606996B1

(12) United States Patent
Thornell et al.

(10) Patent No.: US 6,606,996 B1
(45) Date of Patent: Aug. 19, 2003

(54) ASHTRAY APPARATUS

(75) Inventors: Daniel E. Thornell, Grand Haven, MI (US); Orville V. Crain, Muskegon, MI (US); Fredrick Thornell, Grand Haven, MI (US)

(73) Assignee: TNT Marketing, Inc., Grand Haven, MI (US)

( * ) Notice: Subject to any disclaimer, the term of this patent is extended or adjusted under 35 U.S.C. 154(b) by 0 days.

(21) Appl. No.: 10/118,736

(22) Filed: Apr. 9, 2002

Related U.S. Application Data

(60) Provisional application No. 60/370,800, filed on Apr. 6, 2002.

(51) Int. Cl.[7] ..... A24F 15/08; A47K 1/08

(52) U.S. Cl. ..... 131/241; 131/242; 131/257; 131/240.1; 131/235.1; 131/231; 131/256; 248/312.1; 248/311.2; 220/737; 220/761; 220/763; 220/759; 220/756; 220/769; 220/701

(58) Field of Search ..... 131/231, 235.1, 131/238, 240.1, 257, 256, 236, 241, 242; D27/104; D7/620; 248/312.1, 215, 314, 31.2, 558; 224/482, 926, 543, 560, 278; 220/737, 208, 482, 710.5, 761, 763, 480, 701, 705, 759, 756, 769; 108/46; 294/33, 27.1

(56) References Cited

U.S. PATENT DOCUMENTS

| | | | | |
|---|---|---|---|---|
| 1,805,016 A | | 5/1931 | Schwartz | |
| D172,130 S | | 5/1954 | Coulter | |
| 3,186,414 A | | 6/1965 | Davis | |
| D244,302 S | | 5/1977 | Bradley | |
| 4,133,319 A | | 1/1979 | Bloomfield | |
| D251,174 S | | 2/1979 | Biever | |
| 4,142,537 A | | 3/1979 | Fenelon | |
| D256,279 S | * | 8/1980 | Huggins | D27/14 |
| D258,468 S | | 3/1981 | Whitlock | |
| D266,879 S | | 11/1982 | Pastirik | |
| 4,587,980 A | * | 5/1986 | Tipper | 131/235.1 |
| 4,643,326 A | * | 2/1987 | Klingler | 220/94 R |
| 4,697,780 A | * | 10/1987 | Wenkman et al. | 248/558 |
| D309,352 S | | 7/1990 | Harder et al. | |
| D323,720 S | | 2/1992 | Leung | |
| 5,249,702 A | * | 10/1993 | Topp et al. | 220/705 |
| 5,279,452 A | * | 1/1994 | Huynh | 224/42.45 R |
| D362,921 S | | 10/1995 | Krystek | |
| D395,097 S | | 6/1998 | Barton et al. | |
| D399,025 S | | 9/1998 | Whitlock | |
| 6,237,801 B1 | * | 5/2001 | Liu | 220/592.17 |
| D455,225 S | | 4/2002 | Whitlock | |
| 6,484,989 B1 | * | 11/2002 | Connery | 248/311.2 |

FOREIGN PATENT DOCUMENTS

DE 3504667 * 8/1986

OTHER PUBLICATIONS

"Bobkenwork" ashtray/extinguisher, http://www.nationwidesmokes.com/bobkenwork_frame.htm (2001).*

* cited by examiner

*Primary Examiner*—Dionne A. Walls
(74) *Attorney, Agent, or Firm*—King & Jovanovic, PLC

(57) ABSTRACT

An ashtray apparatus comprising a container, a cap member, and a handle assembly. The container includes a base and a surround member extending from the base. The base and surround member cooperate to define a cavity having an opening. The cap member is engageable with the container. The cap member and container cover at least a portion of the opening of the container. The cap member further includes a channel extending therethrough which permits communication with the cavity of the container. The handle assembly is releasably associable with at least one of the base and the cap member so that a user can selectively utilize the handle assembly.

6 Claims, 10 Drawing Sheets

ASHTRAY APPARATUS

CROSS-REFERENCE TO RELATED APPLICATION(S)

This application claims the benefit of U.S. Provisional Application No. 60/370,800, entitled Ashtray Apparatus, filed Apr. 6, 2002.

BACKGROUND OF THE INVENTION

1. Field of the Invention

The present invention relates in general to an ashtray apparatus and, more particularly, to an ashtray apparatus which has a removable handle capable of storage within the ashtray itself during storage and transport, wherein such an ashtray likewise facilitates the retention of a cigarette, as well as the extinguishing and disposal thereof.

2. Background Art

The use of ashtray apparatuses has been known in the art for countless years. As such, improvements to the ashtray have been made to facilitate the retention, extinguishing, and/or disposal of cigarettes. While such designs have been developed, there have nevertheless been a plurality of drawbacks associated with prior designs. For example, prior designs generally include an integrated handle which may limit the flexibility and usability of the ashtray apparatus. Moreover, ashtrays having integrated handles are generally costly to package and ship inasmuch as they have an odd shape and configuration. As a result, packaging containers for such ashtrays have a volume which remains largely empty when packed with said ashtrays. Furthermore, many ashtray apparatuses are not properly sized to receive a cigarette butt, especially when the cigarette is extinguished prior to being fully spent. Further still, many extinguishing ashtrays are molded from a plastic material which, typically, quickly becomes discolored, melted, and/or burned after only a short usage time.

As a result, it is an object of the present invention to overcome the deficiencies, drawbacks, and/or complications of the prior art.

SUMMARY OF THE INVENTION

The present invention is directed to an ashtray apparatus comprising: (a) a container including: (1) a base; and (2) a surround member extending from the base, the base and surround member cooperating to define a cavity having an opening; (b) a cap member engageable with the container, to, in turn, cover at least a portion of the opening of the container, the cap member including a channel extending therethrough for communication with the cavity of the container; and (c) a handle assembly releasably associable with at least one of the base and the cap member.

In a preferred embodiment of the present invention, the handle assembly further comprises: (a) a housing defining a cavity; and (b) a handle, the handle including: (1) a base having a first end and a second end; (2) a housing tab associated with the first end of the base; and (3) a retaining tab associated with the second end of the base. A portion of the housing tab is releasably retainable within the cavity of the housing.

In another preferred embodiment of the present invention, the retaining tab includes an outwardly concave orientation, substantially matching the outwardly convex orientation of the surround member of the container.

In yet another preferred embodiment, the housing tab and the retaining tab are spaced apart from each other at a predetermined distance.

In a further preferred embodiment of the present invention, the base of the handle is substantially planar.

Preferably, the housing of the handle assembly further includes: (a) a pair of opposing side walls; (b) a top wall extending between the opposing side walls; and (c) an outer wall spanning the opposing side walls and the top wall. In this embodiment, preferably, the outer wall is uniformly spaced apart from the surround member to, in turn, provide a substantially uniform cavity defined thereby.

In another preferred embodiment of the present invention, the handle assembly further comprises a handle which is structurally configured for full insertion into the cavity of the container upon covering of the opening of the container by the cap member.

In yet another preferred embodiment, the handle assembly is structurally configured to be positionable in an orientation within the cavity wherein the retaining tab is in substantial abutment with the base of the container upon covering of the opening of the container by the cap member.

Preferably, the ashtray apparatus further comprising means for locking the handle assembly in an articulated configuration. In this embodiment, preferably, the locking means further comprises: (a) an opening associated with one of the handle and the housing; (b) a pin associated with the other of the handle and the housing, the pin being capable of selective communication with the opening; and (c) means for biasing the pin relative to the opening to selectively facilitate the locking of the housing and the handle in releasable engagement.

In a preferred embodiment of the present invention, the handle assembly comprises: (a) a recess associated with an upper edge of the surround member; and (b) a handle, the handle including: (1) a base having a first end and a second end; (2) a housing tab associated with the first end of the base; and (3) a retaining tab associated with the second end of the base. A portion of the housing tab is releasably positionable within the recess associated with the upper edge of the surround member, and, in turn, is releasably retained by the engagement of the cap member.

In another preferred embodiment, the handle assembly comprises: (a) a recess associated with an outer surface of the surround member; (b) a handle, the handle including; (1) a base having a first end and a second end, the first end of the base member being rotatably mounted to the outer surface of the surround member; and (2) a retaining tab having being rotatably mounted to the second end of the handle, the handle being articulatable from a collapsed orientation, wherein the handle is substantially within the recess, to an articulated orientation.

In yet another embodiment of the present invention, the channel extending through the cap member includes a top end and a bottom end, and wherein the bottom end of the cap member is spaced apart from the base of the container at a predetermined distance, to, in turn, facilitate the passage of a partially smoked cigarette into the cavity of the container. In this embodiment, preferably, the bottom end of the cap member is spaced apart from the base of the container a distance corresponding to about at least approximately 2 inches.

Preferably, the cap member further includes a plurality of cigarette retaining regions.

Additionally, portions of the ashtray apparatus preferably comprise a molded plastic material impregnated with a fire retardant material.

In a preferred embodiment of the present invention, at least a portion of the container and the cap member comprises a molded plastic material impregnated with a fire retardant material.

BRIEF DESCRIPTION OF THE DRAWINGS

The invention will now be described with reference to the drawings wherein.

DETAILED DESCRIPTION OF THE INVENTION

Figure 1:
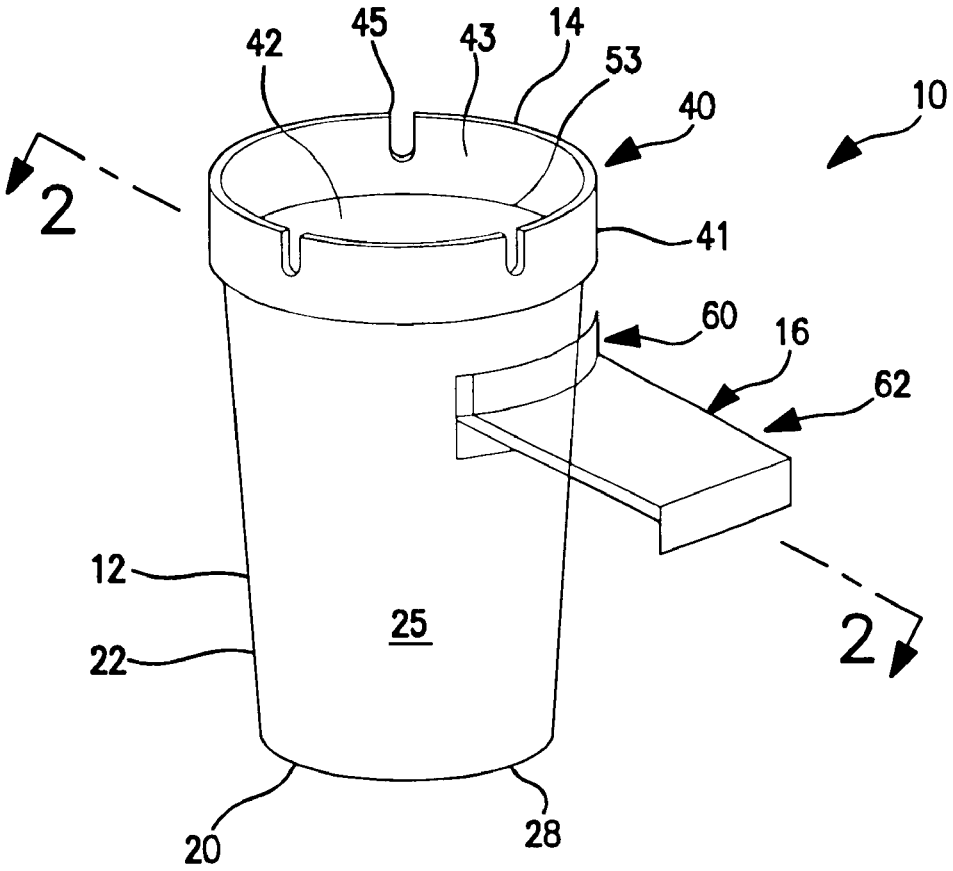
FIG. 1 of the drawings comprises a perspective view of an embodiment of an ashtray apparatus in accordance with the present invention.

While this invention is capable of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, are identified throughout the drawings by like reference characters. In addition, it will be understood that the drawings are merely representations, and some of the components may have been distorted from actual scale for purposes of pictorial clarity.

Figure 2:
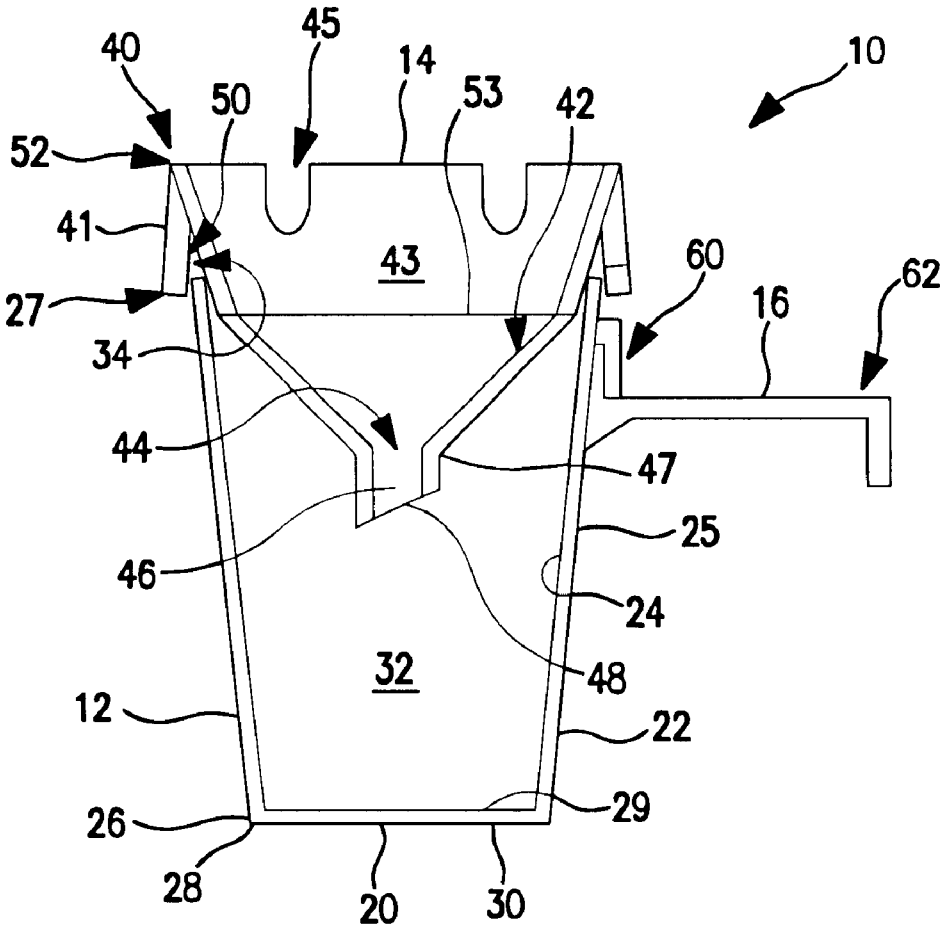
FIG. 2 of the drawings comprises a cross-sectional view of the embodiment of the ashtray apparatus of FIG. 1 taken generally along lines 2—2 of FIG. 1.
Figure 4:
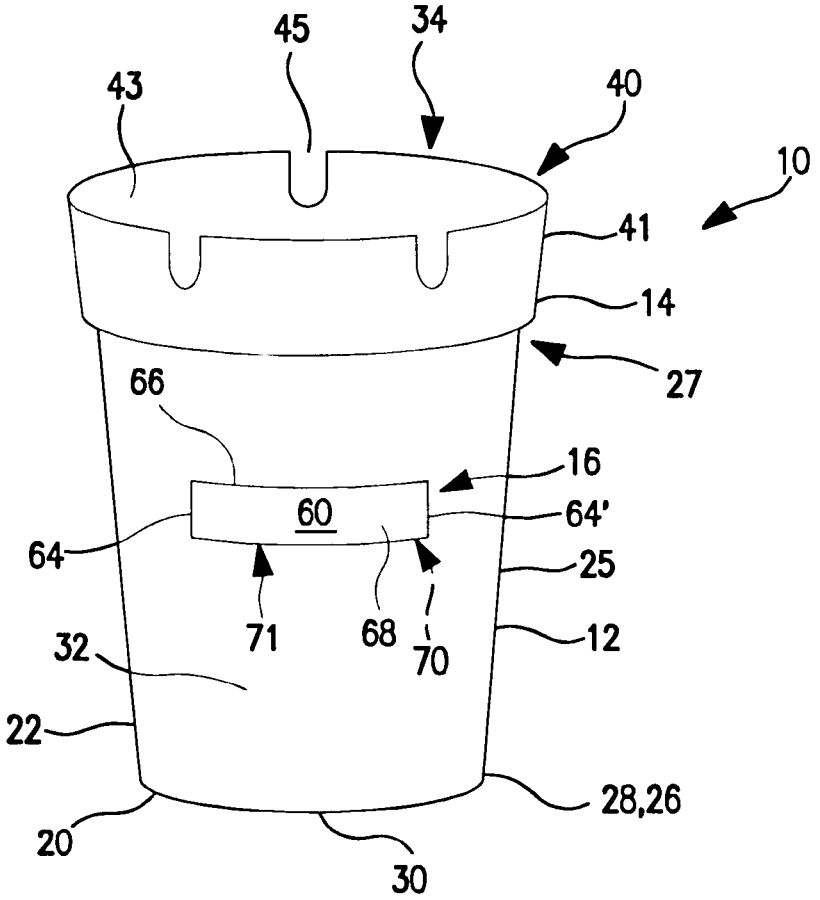
FIG. 4 of the drawings comprises a perspective view of an embodiment of an ashtray apparatus in accordance with the present invention.

Ashtray apparatus 10 is shown in FIGS. 1, 2, and 4 as generally comprising container 12, cap 14, and handle assembly 16. Generally, ashtray apparatus 10 may comprise a variety of materials including plastics, metals, alloys, composites, and other materials. Most preferably, however, it is contemplated that the ashtray may comprise a molded plastic material. It is further contemplated that such an apparatus (and, in particular, certain exposed components thereof) will be impregnated with flame retardant material during molding to provide flame and burning resistance.

As shown in greater detail in FIG. 2, container 12 includes base 20 and surround member 22, which cooperate together to define cavity 32 having opening 34. Base 20 includes perimeter 28, top surface 29 and bottom surface 30. Base 20 may comprise a substantially planar surface, or, alternatively, may comprise a slightly inwardly convex surface. Generally, perimeter 28 comprises a substantially uniform circle, while other geometric shapes, i.e., squares, ellipses, hexagonal shapes, etcetera are also contemplated for use.

Referring again to FIG. 2, surround member 22 includes inner surface 24, outer surface 25, lower edge 26, and upper edge 27. Lower edge 26 of surround member 22 extends around perimeter 28 of base 20 and upwardly therefrom. In the embodiment shown, surround member 22 fans outwardly such that the perimeter of upper edge 27 is larger than perimeter 28 of base 20. Of course, it is likewise contemplated that the lower edge 26 and the upper edge 27 may comprise generally similar shapes, or may comprise substantially different geometric shapes and configurations.

Cap member 14 is shown in detail in FIG. 2 as generally comprising engagement rim assembly 40, channeling member 42, and opening assembly 44. Engagement rim assembly 40 includes outer surface 41, inner surface 43, and cigarette retaining member 45. Outer surface 41 and inner surface 43 are positioned such that they are in a generally spaced apart orientation, defining gully 50, and are joined to each other at upper end 52 thereof. As will be explained, upper edge 27 of container 12 is positioned within gully 50 and, due to the relative dimension therebetween, upper edge 27 is releasably retainable through an interference fit within gully 50. While inner surface 43 is shown as being wider than outer surface 41, such that inner surface 43 extends into cavity 32 of container 12, other shapes and respective dimensions are likewise contemplated.

Channeling member 42, as is shown in FIG. 2, comprises an inwardly sloping surface having outer perimeter 53 integrally attached to inner surface 43 of engagement rim assembly 40. The channeling member extends to opening assembly 44, to, in turn, direct any material contacting inner surface 43 or channeling member 42 into opening assembly 44. Additionally, while the channeling member is shown as being substantially uniform in slope, a plurality of different configurations are likewise contemplated for use, including configurations having varying slopes or shapes.

Opening assembly 44 includes channel 46. Channel 46 includes top end 47 and bottom end 48. Top end 47 is integrally associated with channeling member 42 and bottom end 48 extends downwardly therefrom. In the embodiment shown, the bottom end is angled relative to base 20 such to improve the passage of material therethrough, and to preclude clogging of channel 46. Generally, bottom end 48 is spaced apart from top surface 29 of base 20 a distance of approximately greater than about 2 inches. This is to permit the passage of a partially smoked cigarette through channel 46 into cavity 32.

Figure 3:
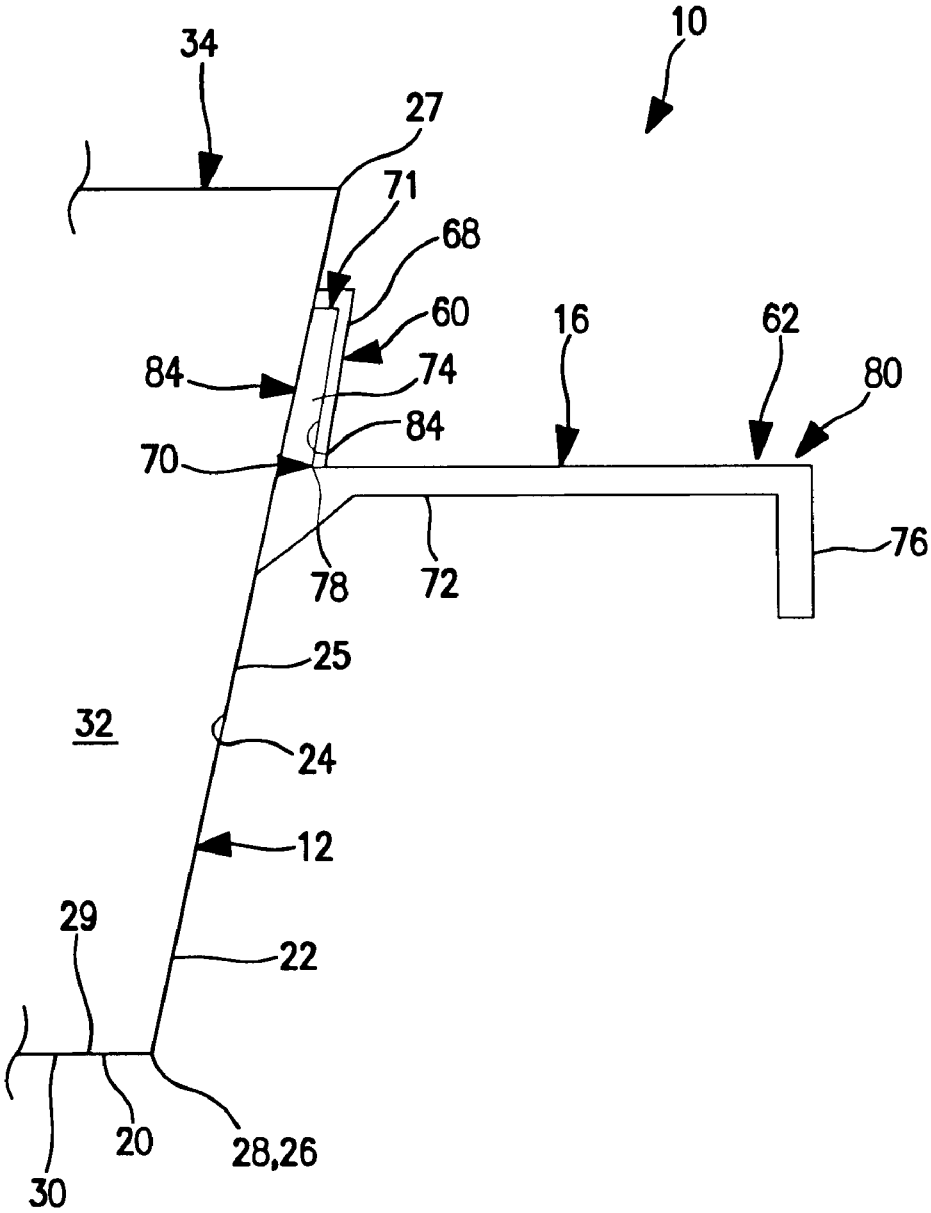
FIG. 3 of the drawings comprises a partial cross-sectional view of the embodiment of the ashtray apparatus of FIG. 1 taken generally along lines 2—2 of FIG. 1.

Handle assembly 16 is shown in FIGS. 1, 2, and 3 as comprising housing 60 and handle 62. Housing 60 is shown in greater detail in FIG. 4 as comprising side walls 64, 64', top wall 66, and outer wall 68. Outer wall 68 spans across the side walls and the top wall, to, in turn define cavity 71 and opening 70. Outer wall 68 is generally parallel to and generally uniformly spaced apart from outer surface 25 of surround member 22. Of course, other configurations are likewise contemplated for use.

Figure 11:
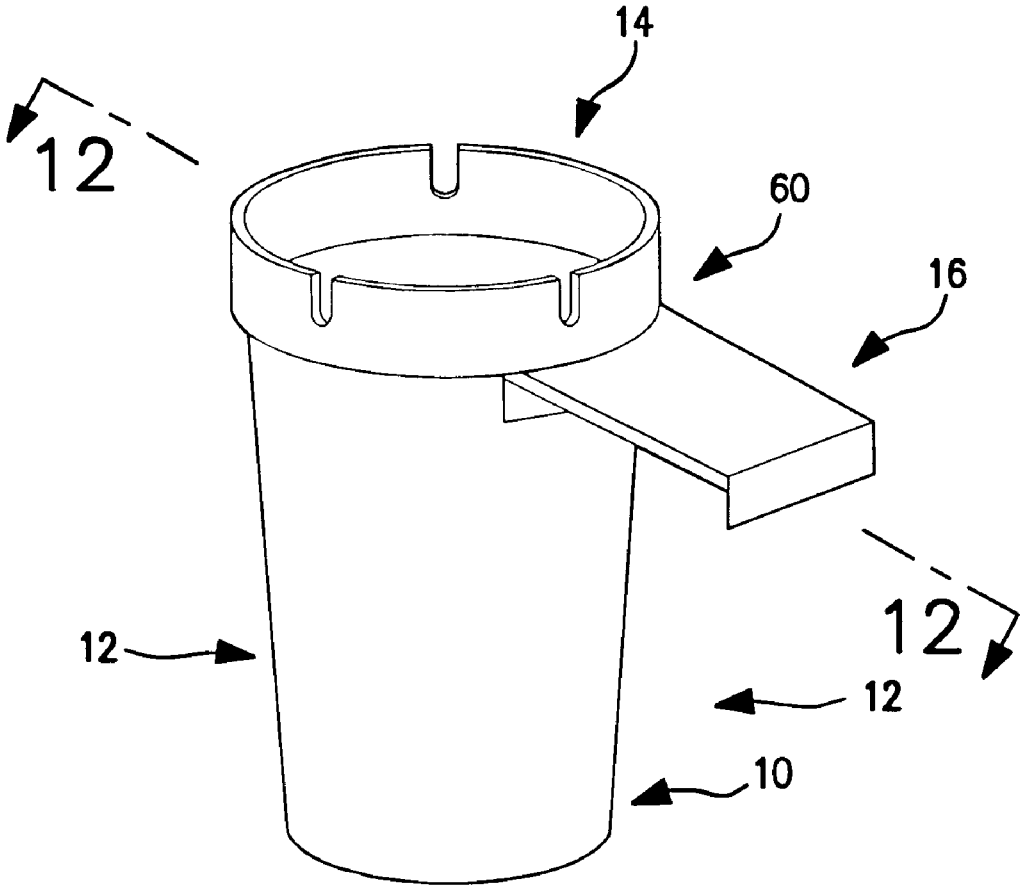
FIG. 11 of the drawings comprises a perspective view of another embodiment of an ashtray apparatus in accordance with the present invention showing the retention of a handle by a cap member.
Figure 12:
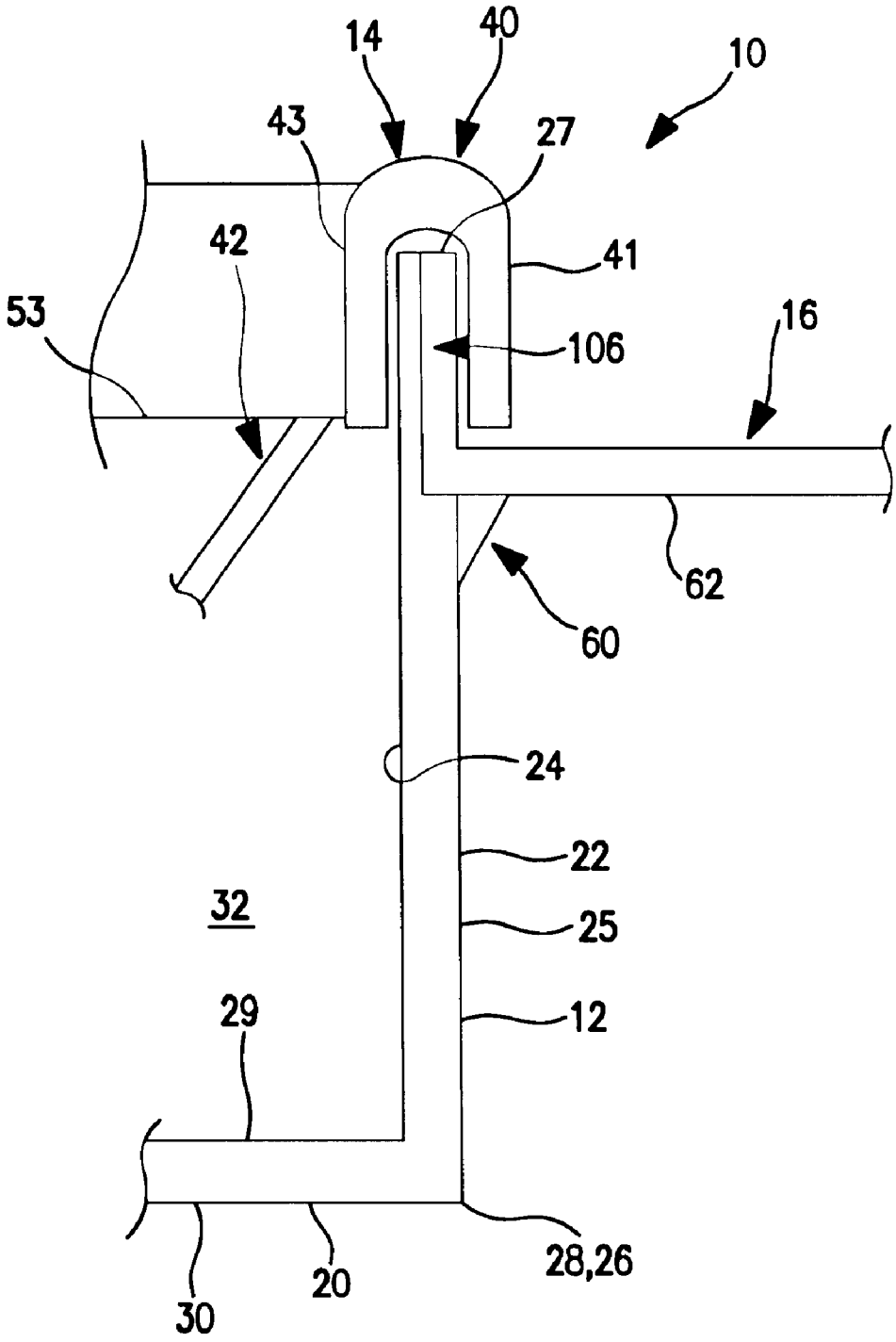
FIG. 12 of the drawings comprises a partial cross-sectional view of the embodiment of the ashtray apparatus of FIG. 11 taken generally along lines 12—12 of FIG. 11.

As shown in FIGS. 11 and 12, it is likewise contemplated in an alternate embodiment that housing 60 may be formed through cooperation between surround member 22 of container 12 and gully 50 of cap member 14. In such an embodiment, the surround member may include recess 106 which is configured to receive a portion of handle 62. Once positioned therein, the handle can be retained by cap member 14.

Figure 5:
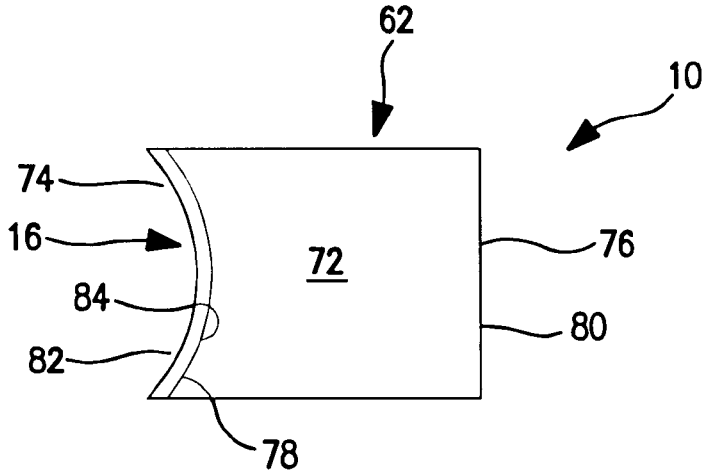
FIG. 5 of the drawings comprises a top plan view of the removable handle of an ashtray apparatus in accordance with the present invention.
Figure 6A:
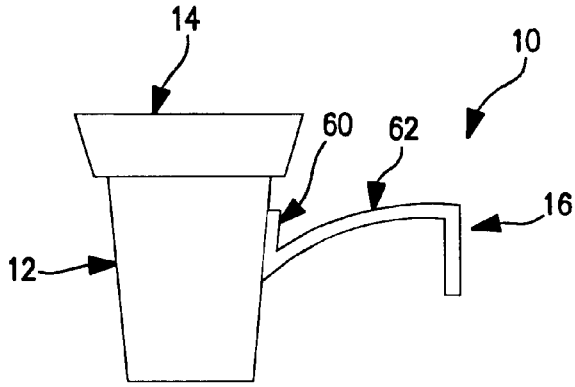
FIGS. 6(*a*)–6(*c*) of the drawings comprise cross-sectional views of an ashtray apparatus in accordance with the present invention showing different configurations of a handle.
Figure 6B:
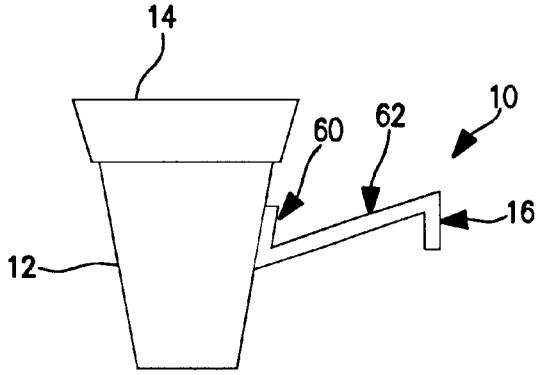
Figure 6C:
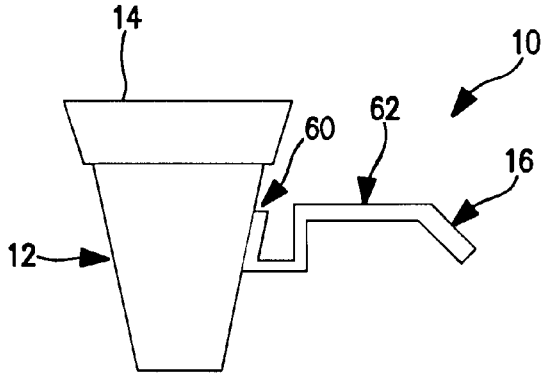

Referring now to FIGS. 3 and 5, handle 62 comprises base 72, housing tab 74, and retaining tab 76. Base 72 is a generally planar material having first end 78 and second end 80 spaced apart from first end 78. Of course, in various other embodiments, as shown in FIGS. 6*a* through 6*c*, handle 62 may be configured to matingly engage a particular outside surface, such as a door, panel, seat, or ride of a vehicle.

Housing tab 74 is shown in FIGS. 3 and 5 as comprising inner surface 82 and outer surface 84. Housing tab 74 is configured so as to be fully insertable within housing 60 of handle assembly 16 (i.e., the housing tab includes an outwardly concave configuration which matingly corresponds to the outward convex configuration of the surround member of the container). Preferably, the dimensions of each of the housing and the housing tab are configured to releasably retain the housing tab therewithin through an interference fit.

Retaining tab 76 is shown in FIGS. 1, 3, and 5 as comprising a substantially planar material associated with second end 80 of base 72. The retaining tab cooperates with the base to facilitate releasable attachment of the apparatus to an outside device. As shown in FIGS. 6*a* through 6*c*, the retaining tab may be of varying length and disposed at varying orientations relative to the container and base 72.

Figure 7:
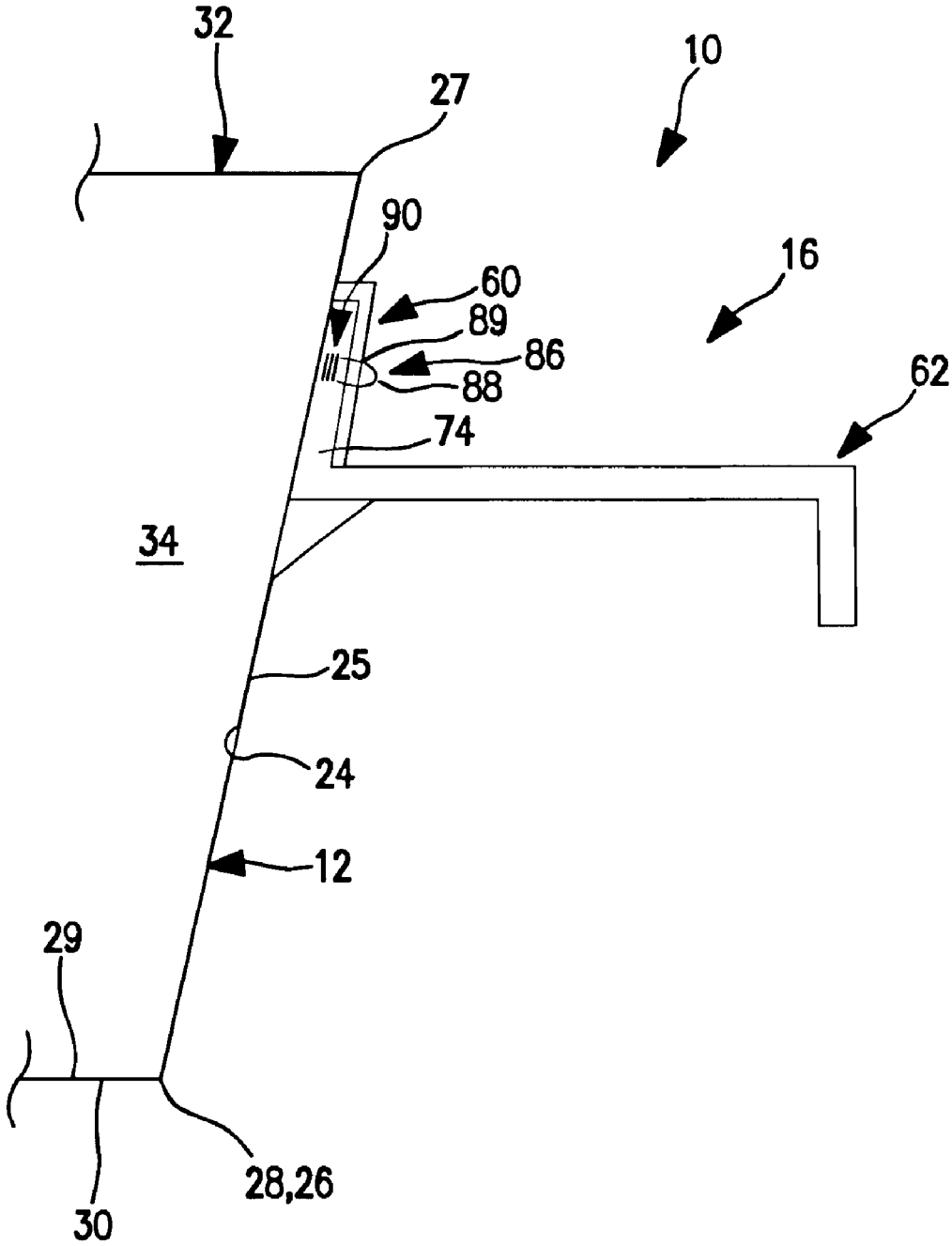
FIG. 7 of the drawings comprises a partial cross-sectional view of an embodiment of an ashtray apparatus in accordance with the present invention having handle locking means.

Of course, as shown in detail in FIG. 7, it is likewise contemplated that releasable locking means 86 may be employed to facilitate the locking of housing tab 74 and housing 60 in an engaged position. In the embodiment shown, releasable locking means 86 includes pin 88, opening 89, and means 90 for biasing pin 88 within opening 89. As can be shown, pin 88 is associated with housing tab 74 and opening 89 is associated with housing 60. In one embodiment, biasing means 90 may comprise the natural resilience of the material itself and its tendency to deform elastically. In other embodiments, a spring of any one of a number of designs may be employed for use.

To assemble the handle of an ashtray apparatus of the present invention, the user is provided with container 12, cap member 14, and handle 62. Once provided, the user inserts retaining tab 72 of handle 62 into opening 70 of housing 60. The handle is then ready for use.

Advantageously, the handle is structurally configured to fit within the cavity of the container with the cap member in place. As such, the device can be shipped with handle 62 separately positioned within cavity 32. Thus, storage, packaging, and shipping costs of a device of the present invention are greatly reduced. In addition, the user can selectively utilize the handle only when it is desirable to do same. At other times, the handle can be removed and stowed.

Next, to prepare ashtray apparatus 10 for operation, the user removes cap member 14. Once removed, the user fills a portion of container 12 with a fluid, such as water. Once a predetermined amount of water is introduced, the cap member is replaced onto the container. As the user smokes, the user can place a cigarette within retaining member 45. The user can additionally dispense ashes onto channeling member 42, and the ashes will be driven to channel 46, and in turn, into cavity 32 of container 12.

When the user is done with the cigarette, the user can dump the entire cigarette butt into the container through channel 46. Advantageously, the container is of a predetermined depth, and bottom 48 of channel 46 is spaced apart from base 20 of container 12 by a distance greater than about 2 inches. As such, a cigarette can easily be passed through channel 46, even when the cigarette is only partially smoked and still of a substantial length.

Once the user is done using the device, the user can remove cap member 14 from container 12. Once removed, the user can clean cavity 32 so that the device can be stowed for future use.

Figure 8:
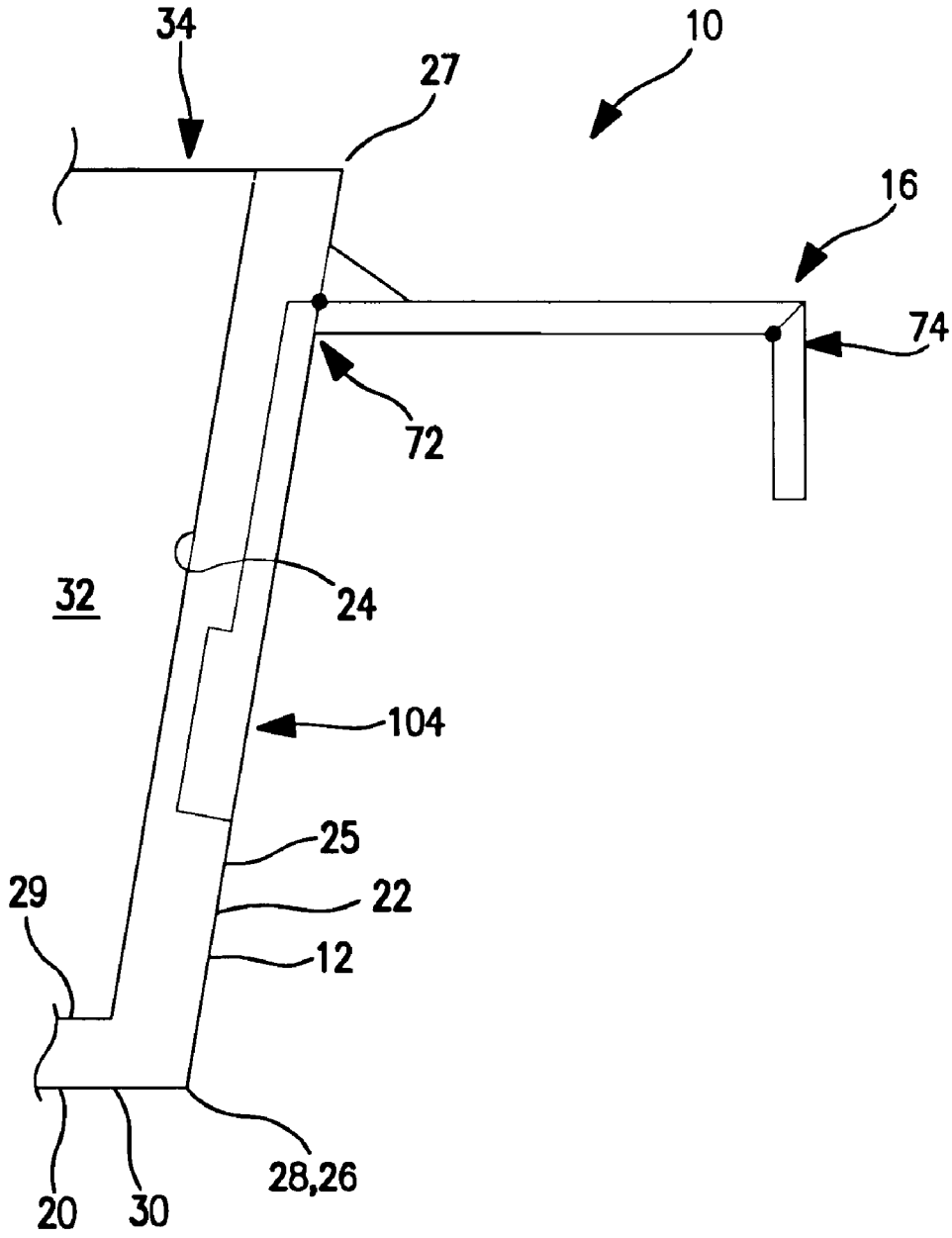
FIG. 8 of the drawings comprises a partial cross-sectional view of an embodiment of an ashtray apparatus in accordance with the present invention having a retractable handle assembly, shown in a fully articulated orientation.
Figure 9:
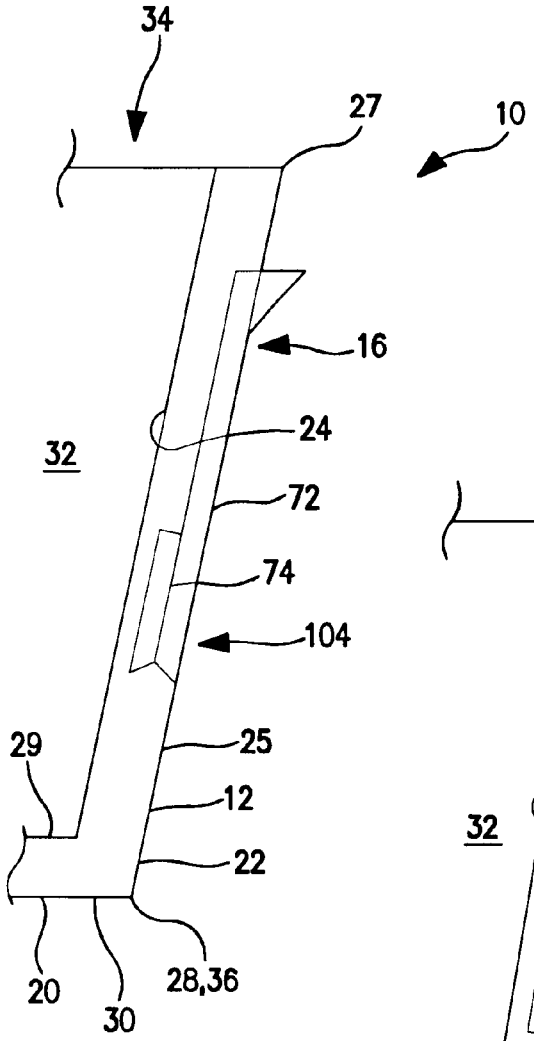
FIG. 9 of the drawings comprises a partial cross-sectional view of an embodiment of an ashtray apparatus in accordance with the present invention having a retractable handle assembly, shown in a fully collapsed orientation.
Figure 10:
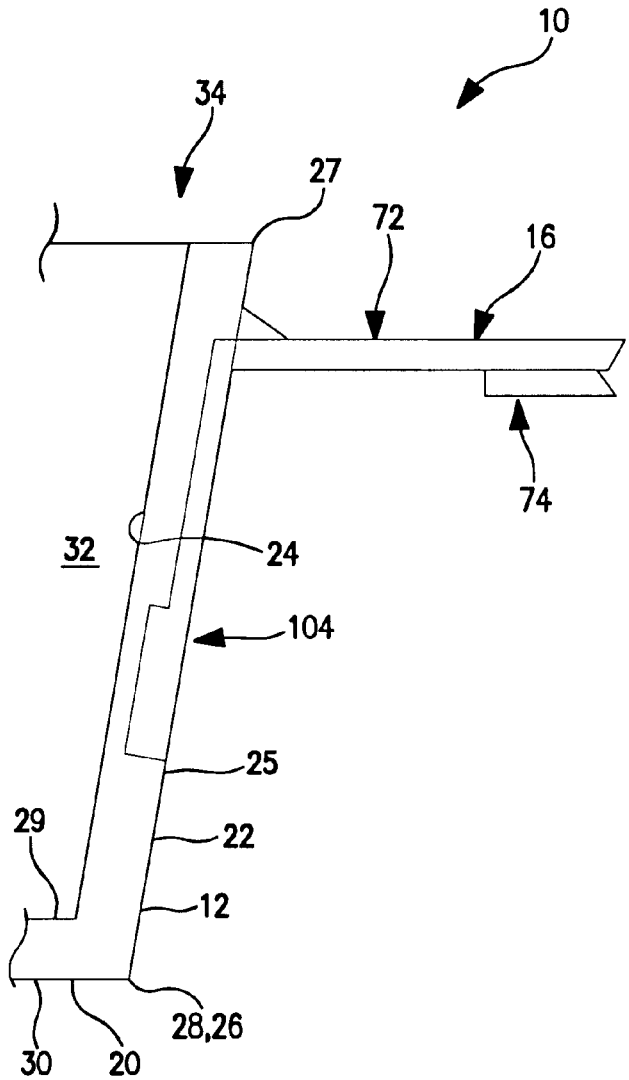
FIG. 10 of the drawings comprises a partial cross-sectional view of an embodiment of an ashtray apparatus in accordance with the present invention having a retractable handle assembly, shown in a partially articulated orientation.

Referring now to FIGS. 8 through 10, another embodiment of the invention is shown generally at 10. In particular, it is contemplated that handle assembly 16 may comprise a handle that can be articulated from a collapsed position to an articulated position for facilitating attachment to another surface. Such an embodiment includes rotatable handle base 72 having rotatable retaining tab 74. Surround member 22 of container 12 includes recessed region 104 which is capable of retaining the handle base and tab in a collapsed orientation.

To operate such an embodiment, the base is first positioned in a collapsed orientation, as shown in FIG. 9, such that base 72 and retaining tab 74 are within recessed region 104. Next, as shown in FIG. 10, the base is first rotated from the collapsed orientation through an arcuate distance of about a quarter rotation. Finally, as shown in FIG. 8, retaining tab 74 is articulated another rotational arcuate distance relative to base 72. Due to the construction of the pivoting interfaces, the handle can be releasably maintained in the articulated position. Of course, a variety of different articulation systems are contemplated, and the disclosed system is but one structural example of an articulatable handle assembly.

The foregoing description merely explains and illustrates the invention and the invention is not limited thereto except insofar as the appended claims are so limited, as those skilled in the art who have the present disclosure before them will be able to make modifications without departing from the scope of the invention.

What is claimed is:

1. An ashtray apparatus, comprising:

a container including:

a base; and a surround member extending from the base, the base and surround member cooperating to define a cavity having an opening;

a cap member engageable with the container, to, in turn, cover at least a portion of the opening of the container, the cap member including a channel extending therethrough for communication with the cavity of the container; and a handle assembly including a handle releasably attachable to at least one of the surround member and the cap member, and substantially fixed and substantially precluded from rotation relative to the container in an attached configuration; wherein the handle assembly further comprises:

a recess associated with an upper edge of the surround member; and a handle, the handle including:

a handle base having a first end and a second end;

a housing tab associated with the first end of the handle base; and a retaining tab associated with the second end of the handle base; and wherein a portion of the housing tab is releasably positionable within the recess associated with the upper edge of the surround member, and, in turn, is releasably retained by the engagement of the cap member.

2. The ashtray apparatus of claim 1, wherein the channel extending through the cap member includes a top end and a bottom end, and wherein the bottom end of the cap member is spaced apart from the base of the container at a predetermined distance, to, in turn, facilitate the passage of a partially smoked cigarette into the cavity of the container.

3. The ashtray apparatus of claim 2, wherein the bottom end of the cap member is spaced apart from the base of the container a distance corresponding to about at least approximately 2 inches.

4. The ashtray apparatus of claim 1, wherein the cap member further includes a plurality of cigarette retaining regions.

5. The ashtray apparatus of claim 1, wherein at least a portion of the container and the cap member comprises a molded plastic material impregnated with a fire retardant material.

6. An ashtray apparatus, comprising:

a container including:

a base; and a surround member extending from the base, the base and surround member cooperating to define a cavity having an opening;

a cap member engageable with the container, to, in turn, cover at least a portion of the opening of the container, the cap member including a channel extending therethrough for communication with the cavity of the container;

a handle assembly associable with the surround member, the handle assembly further comprises:

a recess associated with an outer surface of the surround member;

a handle, the handle including;

a handle base having a first end and a second end, the first end of the handle base member being rotatably mounted to the outer surface of the surround member; and a retaining tab being rotatably mounted to the second end of the handle;

wherein the handle is articulatable from a collapsed orientation, wherein the handle is substantially within the recess, to an articulated orientation.

* * * * *